US006786173B2

(12) United States Patent
Courtemanche

(10) Patent No.: US 6,786,173 B2
(45) Date of Patent: Sep. 7, 2004

(54) ADJUSTABLE MARKER

(76) Inventor: Denis Courtemanche, 6844 43rd Avenue, Montreal QC (CA), H1T 2S3

( * ) Notice: Subject to any disclaimer, the term of this patent is extended or adjusted under 35 U.S.C. 154(b) by 0 days.

(21) Appl. No.: 10/164,886

(22) Filed: Jun. 10, 2002

(65) Prior Publication Data

US 2003/0226495 A1 Dec. 11, 2003

(51) Int. Cl.[7] ..... E01F 9/00

(52) U.S. Cl. ..... 116/63 P; 116/63 R; 40/606.14; 248/156; 248/533

(58) Field of Search ..... 116/63 P, 63 R; 40/645, 607.01, 606.14, 606.15, 606.17; 248/156, 330, 533, 284.1, 530

(56) References Cited

U.S. PATENT DOCUMENTS

| | | | | | |
|---|---|---|---|---|---|
| 2,610,548 | A | * | 9/1952 | Isenberg | 116/63 P |
| 3,067,717 | A | * | 12/1962 | Imparato | 116/63 P |
| 3,421,473 | A | * | 1/1969 | Weichenrieder | 116/63 P |
| 3,802,370 | A | | 4/1974 | Kessler | |
| 3,863,595 | A | * | 2/1975 | Barnett et al. | 116/63 R |
| 3,903,626 | A | * | 9/1975 | Ford | 40/606.14 |
| 4,106,879 | A | * | 8/1978 | Diedershagen et al. | 116/63 R |
| 4,402,166 | A | * | 9/1983 | Wortham, Jr. | 248/156 |
| 4,599,012 | A | * | 7/1986 | Kugler et al. | 116/63 R |
| 4,636,109 | A | * | 1/1987 | Clausen et al. | 116/63 P |
| 5,207,175 | A | * | 5/1993 | Andonian | 116/63 R |
| 5,718,072 | A | * | 2/1998 | Garfinkle | 40/606.15 |
| 5,879,103 | A | | 3/1999 | Baillie | |
| 6,514,006 | B1 | * | 2/2003 | Hines | 116/63 R |
| 6,530,166 | B1 | * | 3/2003 | Garfinkle et al. | 40/606.14 |

FOREIGN PATENT DOCUMENTS

| | | |
|---|---|---|
| CA | 2087292 | 7/1994 |
| CA | 2114578 | 8/1995 |

* cited by examiner

*Primary Examiner*—Diego Gutierrez
*Assistant Examiner*—Travis Reis

(57) ABSTRACT

An adjustable marker for delimiting boundaries comprised of a spacing rod, an anchoring peg and a pivotal connection pivotably engaging between the said spacing rod and the said anchoring peg.

5 Claims, 7 Drawing Sheets

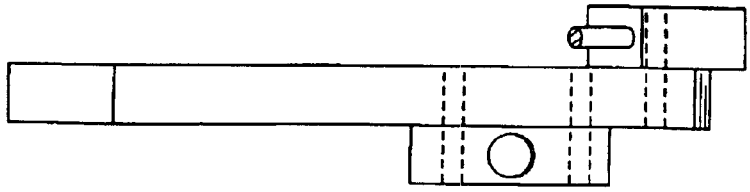
FIG. 12
FIG. 13
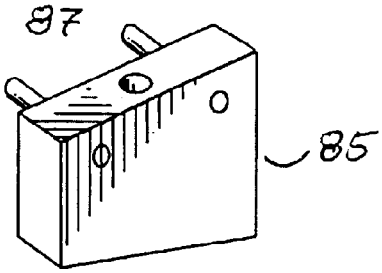
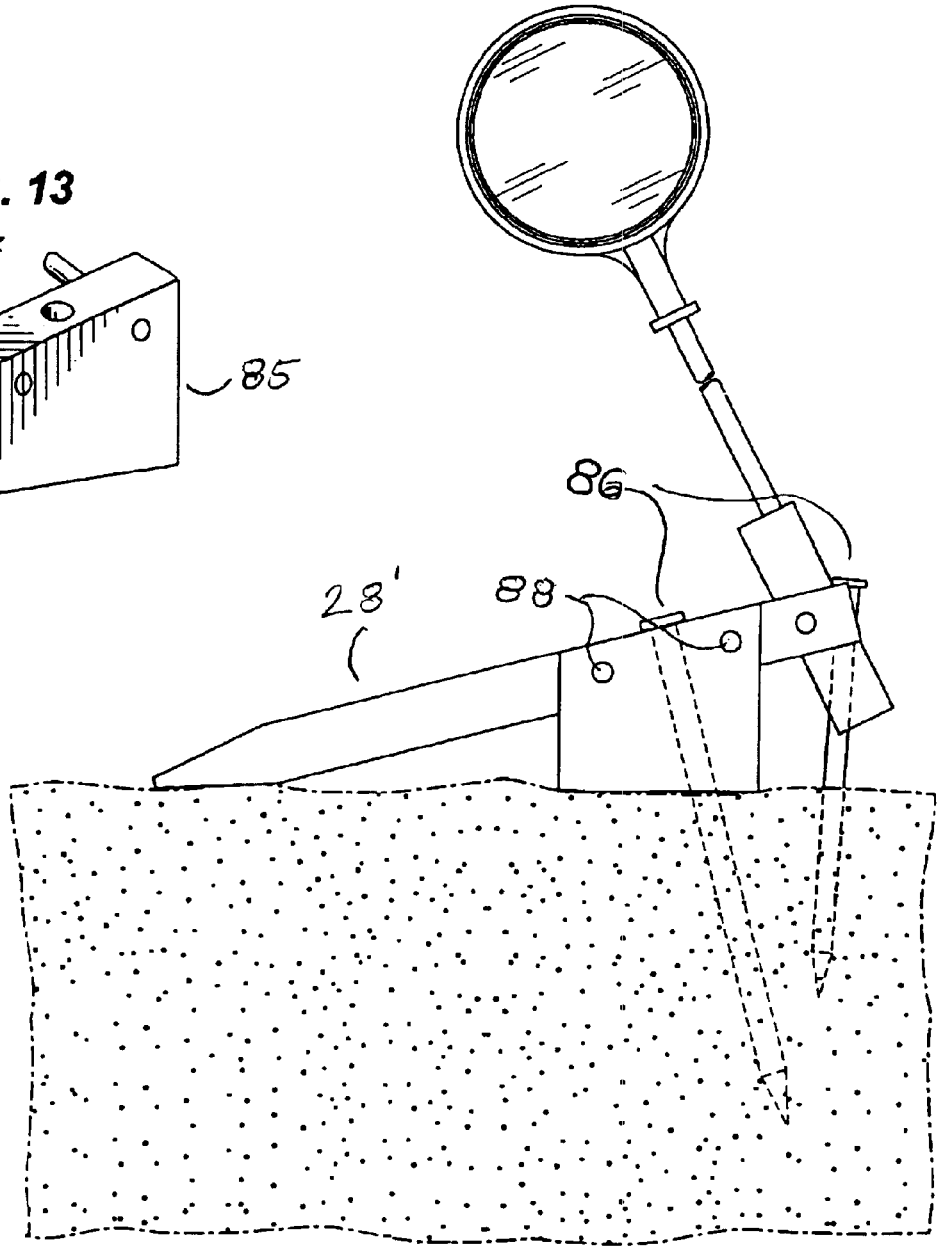
FIG. 11

ADJUSTABLE MARKER

Applicant claims priority based on Request for grant of a patent application No. 0114566.3 filed on the Jun. 15, 2001 for claims 1 through 4 inclusive.

BACKGROUND OF THE INVENTION

1. Field of the Invention

The present invention relates to the general field of marking devices and is particularly concerned with an adjustable marker.

2. Background of the Invention

There exists a plurality of situations wherein it is desirable to use a marker to indicate the location of an edge such as a driveway edge, a fence, an hedge or the like. In regions where winter climates involves snowfalls, marking devices are particularly useful since they provide visual boundaries that can be used instead of the usual boundaries that are often covered by snow, ice or the like. Indeed, in most industrial countries where winter-like conditions involve snowfalls, it is common practice to use motorized snow removal equipment to clean sidewalks. Since the boundaries between the sidewalk and the residential properties are often covered with snow, it is difficult for the operators of such snow removal machinery to effectively clean the sidewalks without eventually scraping or otherwise impacting the hedges, fences or other residential properties.

In order to allow for the marking of the boundaries between the driveways, sidewalks and the like from the lawns, hedges and the like some prior art devices have been proposed. Typically, conventional marking devices include; metal rods generally coated with a colored coating and intended to be thrust into the lawn at the edge of the driveway or the sidewalk at strategic locations to indicate the location of the driveway or sidewalk edge. Although useful in providing visual guidance, in practice, sooner or later, a snow removal machinery or other vehicle will brush against these driveway markers and bend them out of position. Furthermore, the metal trim of the marker may potentially scratch the vehicle.

Other disadvantages associated with such prior art is that they are difficult to install and remove.

Another main drawback associated with such prior art structure is that they lack configuration and adjustability, requiring that the anchored base of the marking device be substantially in line with the actual visual marking section.

Accordingly, there exists a need for an improved marking device.

SUMMARY OF THE INVENTION

Advantages of the present invention include the fact that the proposed marking device is particularly well suited to provide visual guidance for delimiting the boundary between public and residential areas and for providing a visual indication about the presence of objects such as fences, hedges and the like to prevent these structures from being damaged by snow removal vehicles or the like. The proposed marking device is specifically designed to be easily anchored into the ground surface without requiring special tooling or manual dexterity. Furthermore, the proposed device is also designed to be easily removable from the ground surface when no longer needed.

Also, the proposed marking device is specifically configured to provide enhanced visibility to reduce the risks of scratching or otherwise damaging a vehicle that may inadvertently impact the marking device.

Still further, the proposed marking device is specifically designed to allow adjustability of its configuration, thus increasing its versatility at various settings. Furthermore, the proposed marking device is specifically designed to be manufacturable using conventional forms of manufacturing to produce a marking device that will be economically feasible, long lasting and relatively trouble free in operation.

BRIEF DESCRIPTION OF THE DRAWINGS

An embodiment of the present invention will now be disclosed, by way of example, in reference to the following drawings, in which:

FIG. 11: Is a side elevation of a marker with the block adapter.

FIG. 12: Is a top elevation from FIG. 11

FIG. 13: Is a perspective view of the block adapter.

DETAILED DESCRIPTION OF THE PREFERRED EMBODIMENTS

Figure 1:
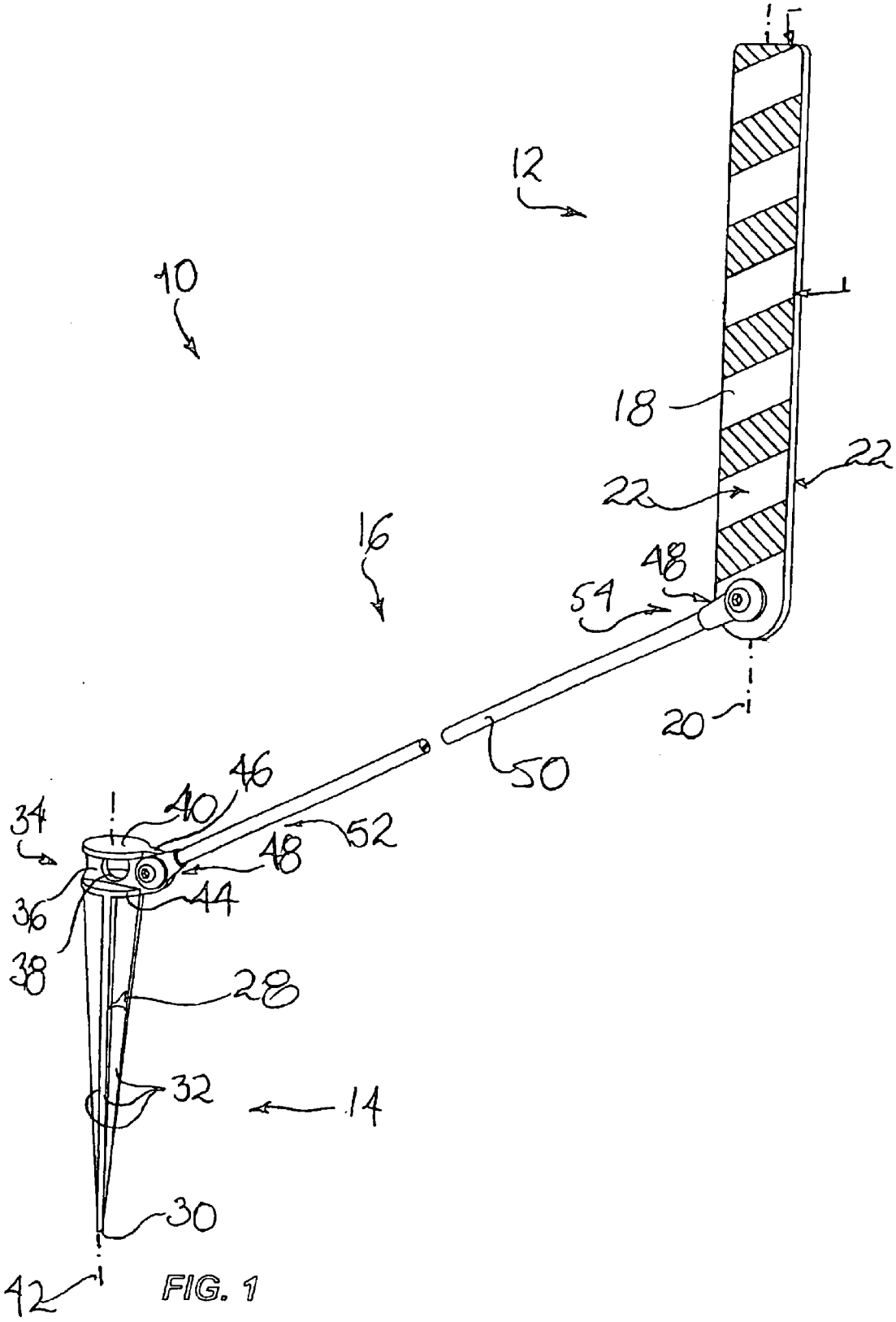
FIG. 1: In a perspective view, illustrates a marking device in accordance with an embodiment of the present invention.

Referring to FIG. 1, there is shown in the perspective view an adjustable marker (10) in accordance with an embodiment of the present invention. The marker (10) defines a visual guiding section (12) for providing an easily visible visual sign, an anchoring section (14) for anchoring the device (10) to a ground surface and an intermediate spacing section (16) for positioning the visual guiding section (12) relative to the anchoring section (14). The visual guiding section (12) includes a guiding strip (18) typically having a generally elongated rectangular and flat configuration defining a strip longitudinal axis (20). The strip (18) defines a pair of opposed guiding surfaces (22) that are typically painted, coated or otherwise marked with visual enhancing means for enhancing the visibility of the strip (18).

The anchoring section (14) includes an anchoring peg (28) having a generally pointed configuration defining a tip (30). Typically, although by no mean exclusively, the peg (28) defines a set of orthogonal ribs (32) tapering downwardly towards the tip (30). The peg (28) also defines a manipulating section (34) located opposite the tip (30). The manipulating section (34) includes a tag spacing wall (36)

extending from an upper segment of the ribs (32). The spacing wall (36) is provided with a grasping aperture (38) extending therethrough. The grasping aperture (38) is configured and sized for receiving a finger of an intended user or another body part or implement used for pulling the peg (28) out of the ground surface when needed.

The peg (28) also includes a hammering wall (40) mounted over the spacing wall (36). The hammering wall (40) extends in a geometrical plane substantially perpendicular to the longitudinal axis (42) of the peg (28). The hammering wall (40) is configured and sized for allowing a hammer, a mallet or similar objects to be used for hammering the peg (28) into the ground surface. Preferably, the spacing wall (36) extends from a transitional wall (44) ending in a generally parallel relationship to the hammering wall (40) and positioned intermediate to the ribs (32) and the spacing wall (36).

The peg (28) also includes a connecting tongue (46) extending laterally form the spacing wall (36). The connecting tongue (46) is configured and sized for receiving a pivotal connection (48) hereinafter disclosed in greater details.

Preferably, the ribs (32), the transitional wall (44), the spacing wall (36), the hammering wall (40) and the connecting tongue (46) are all made of an integral piece of material.

The spacing section (16) includes a generally elongated spacing rod (50). The spacing rod (50) defines a spacing rod first longitudinal end (52) and an opposed spacing rod second longitudinal end (54). The spacing rod first and second longitudinal ends (52), (54) are pivotally attached respectively to the connecting tongue (46) and to a proximal segment of the strip (18) by corresponding pivotal connections (48).

Figures 2, 3:
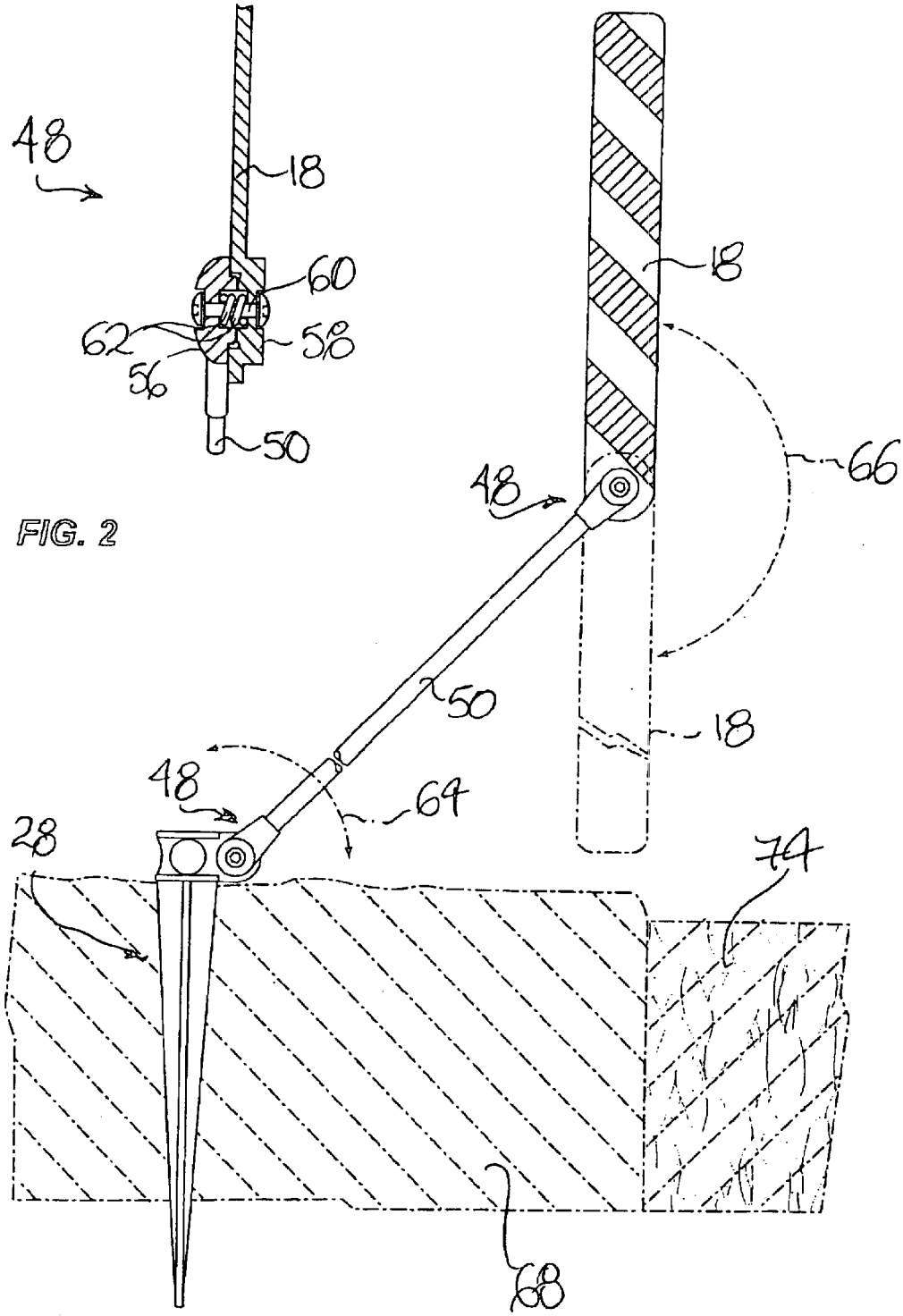
FIG. 2: In a partial cross sectional view, illustrates a pivotal link between sections of the marking device shown in FIG. 1.
FIG. 3: In a partial front elevational view with sections taken out, illustrates the marking device shown in FIG. 1 anchored into a ground surface and with some of its sections being pivoted between various configurations.

One of the pivotal connections (48) is illustrated in greater details in FIG. 2. Each pivotal connection (48) includes a pair of cooperating pivotal discs (56), (58) having matching internal configurations and pivotally connected together by a pivoting pin (60). A biasing component such as an helicoidal type spring (62) is mounted within the casing formed by the discs (56), (58) so as to bias the discs (56), (58) to releasably lock the configuration. The pivotal connection (48) allows for pivotal movement respectively of the spacing rod (50) relative to the peg (28) and of the strip (18) relative to the spacing rod (50) according to arrows (64) and (66) as illustrated in FIG. 3.

Figure 4:
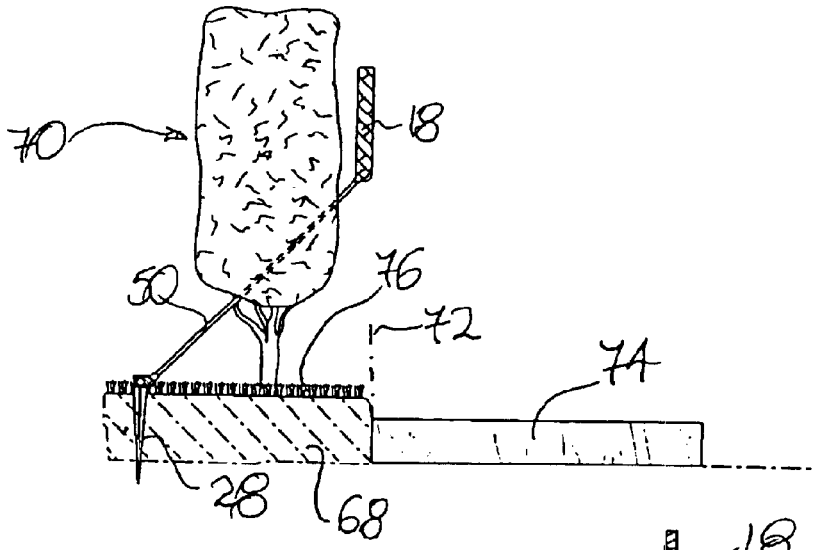
FIG. 4: In a front elevational view, illustrates the marking device shown in FIGS. 1 through 3 being used for marking the boundary between a sidewalk and an hedge of trees planted in a residential lawn.

In use, as illustrated in FIG. 4, the peg (28) is anchored into the ground surface (68) using a hammer, a mallet or the like to drive the peg (28) into the ground surface (68). In situations, such as shown in FIG. 4, wherein the marker (10) is adapted to be used for indicating the presence of a tree hedge (70), the peg (28) is typically positioned inwardly relative to the tree hedge and the spacing rod (50) is positioned at an angle outwardly so that the marking strip (18) is positioned outwardly relative to the tree hedge (70) typically in a proximal relationship relative to a vertical plane (72) defining border between the sidewalk (74) and the lawn (76). The angle of the spacing rod (50) is typically adjusted depending on the configuration of the landscape. Optionally, the spacing rod (50) could be provided with length adjustment means such as a telescopic length adjustment means for allowing adjustment of the length of the spacing rod (50) depending on the specific configuration of the landscape.

Figure 5:
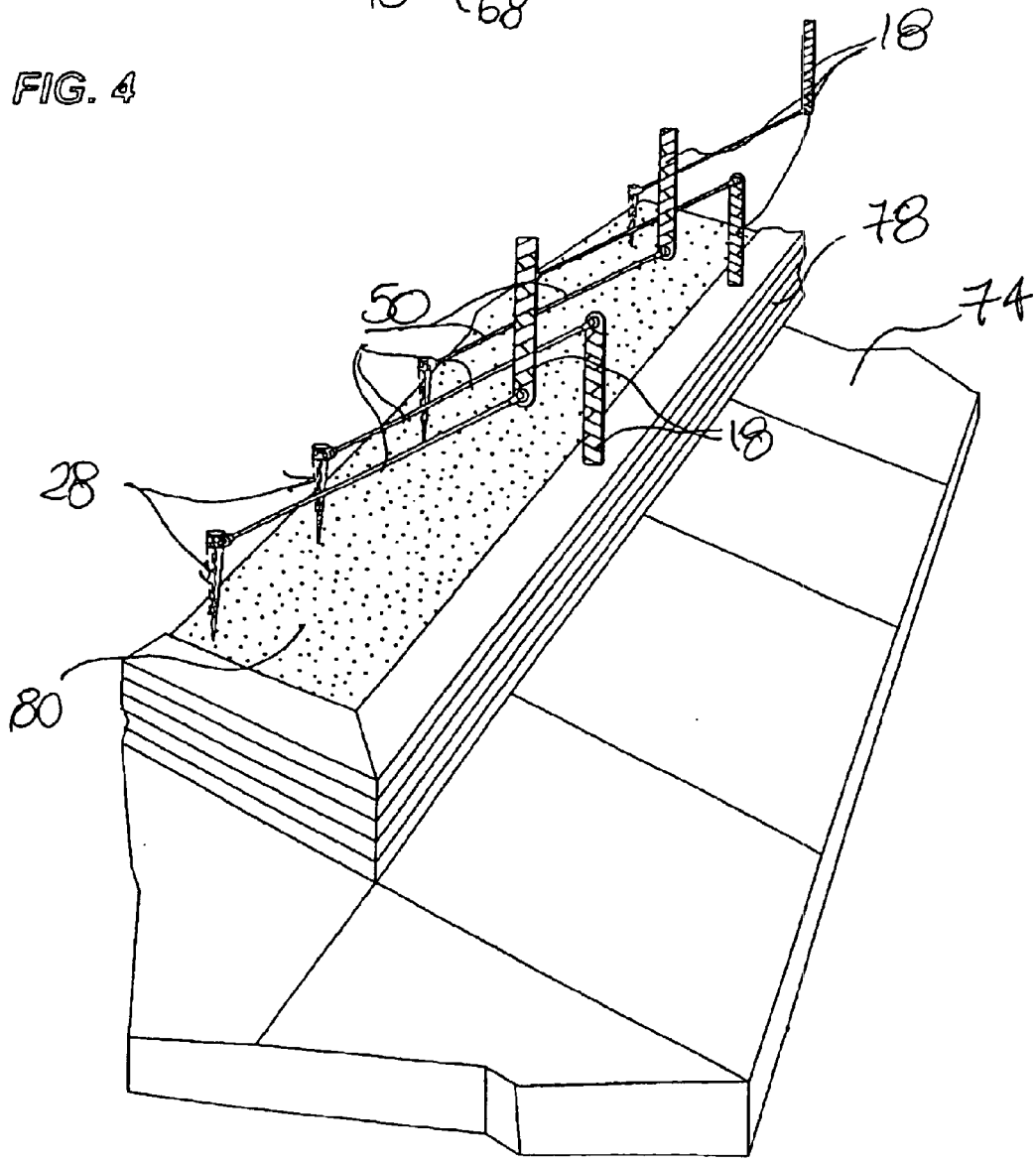
FIG. 5: In a partial perspective view with sections taken out, illustrates a set of marking devices in accordance with the present invention being used for marking the edge between a sidewalk and an elevated lawn.

FIG. 5 illustrates a situation where a set of markers (10) are used to indicate the border between the sidewalk (74) and the vertical wall (78) defining the edge of a property (80). The pegs (28) and spacing rods (50) are positioned and configured so that the indicating strips (18) lie substantially in the same geometrical plane. It should be understood that the marker (10) could be used in other settings and with other configurations without departing from the scope of the present invention.

Figure 6:
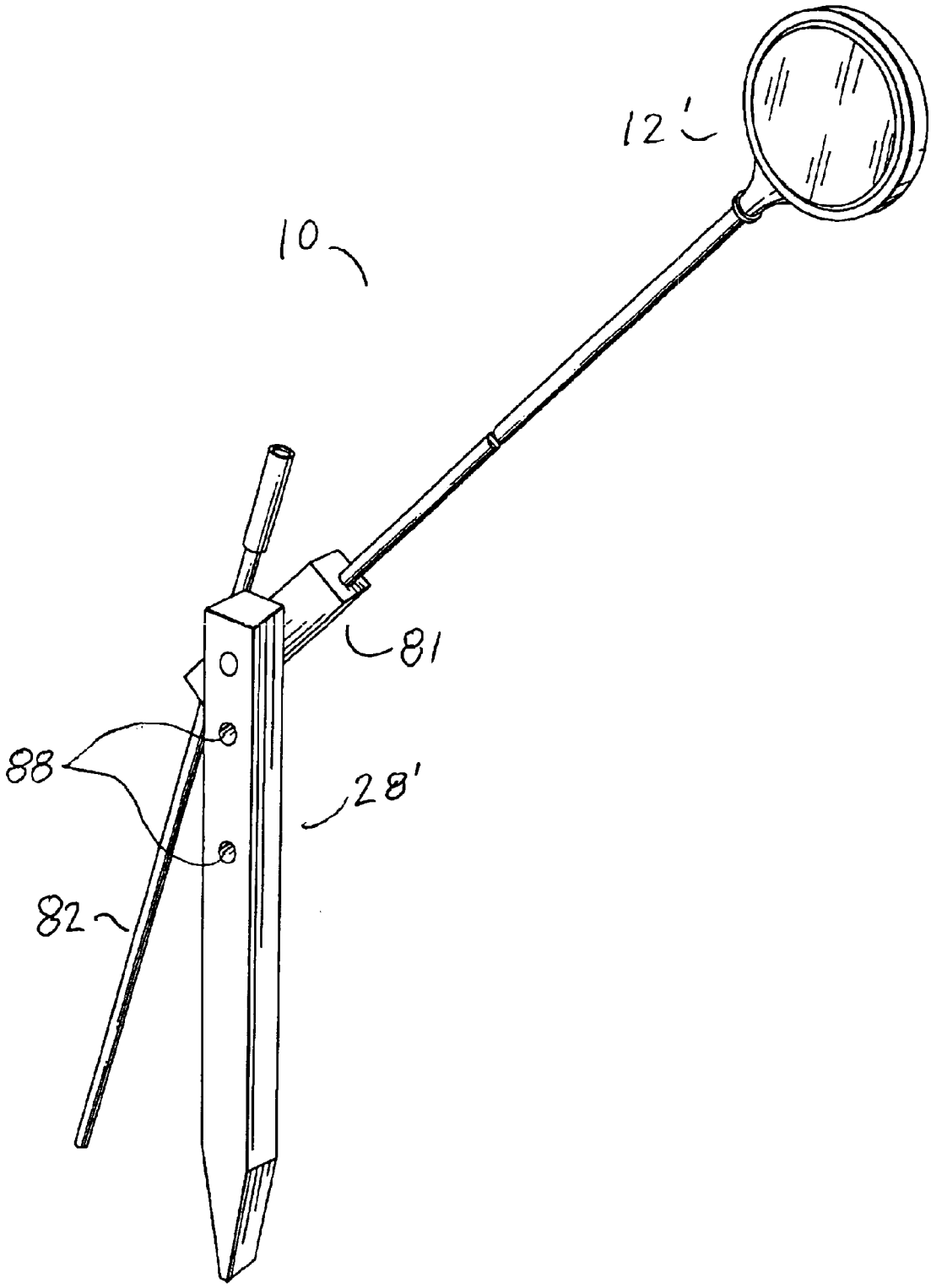
FIG. 6: Is a perspective view of an alternate embodiment of the invention.
Figure 8:
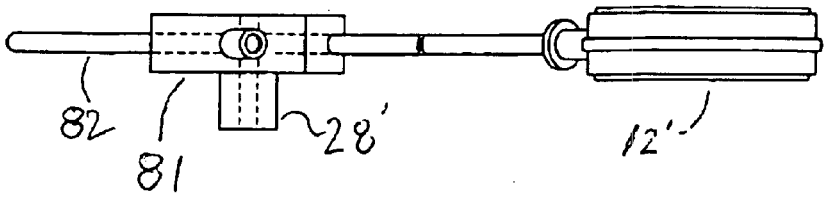
FIG. 8: Is a top elevation of the alternate embodiment.
Figure 7:
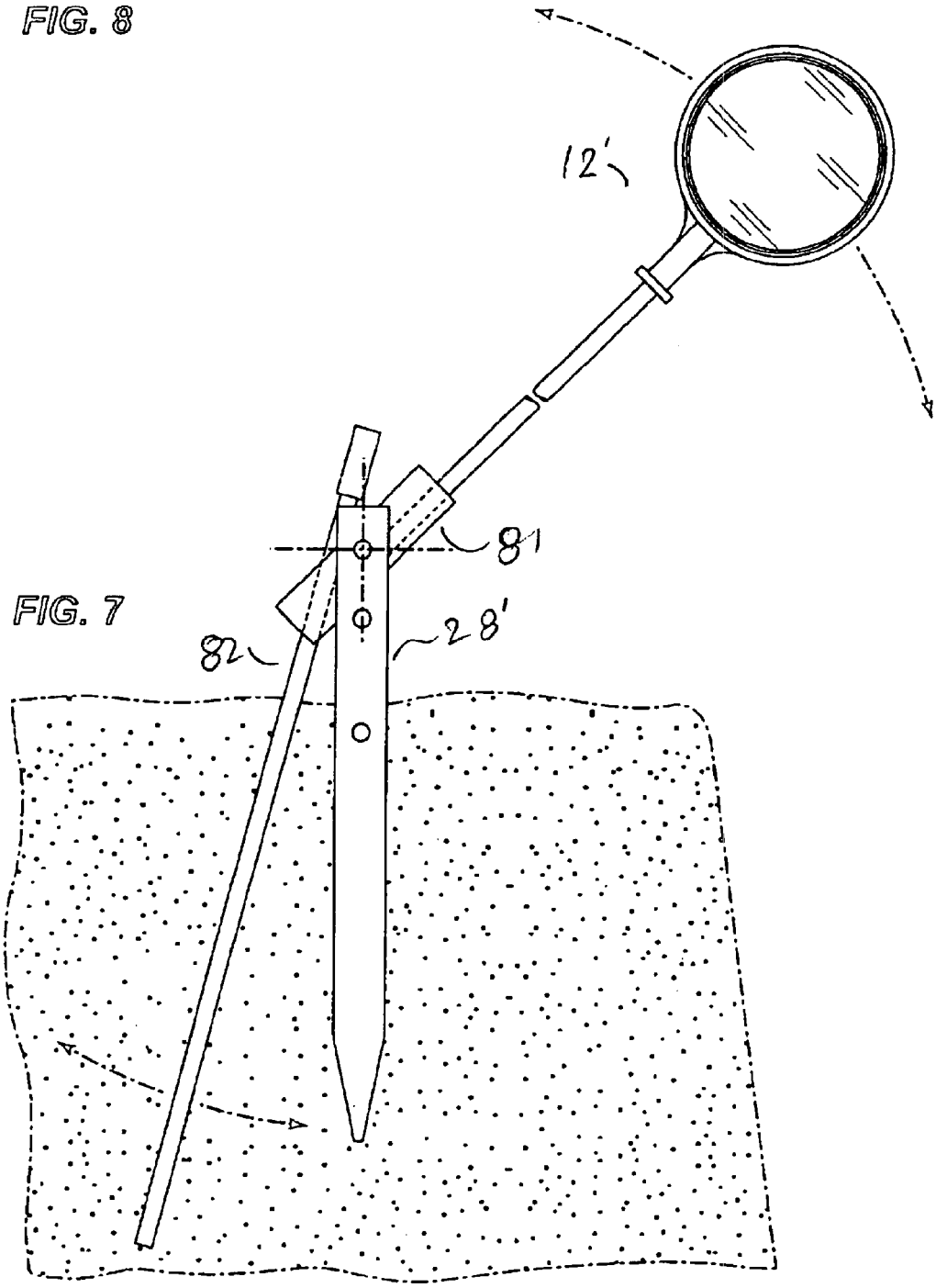
FIG. 7: Is a front elevation of the alternate embodiment in use.
Figure 9B:
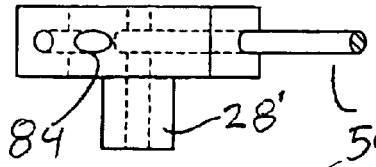
FIGS. 9*abc*: Show a top and two side views detail.
Figure 9A:
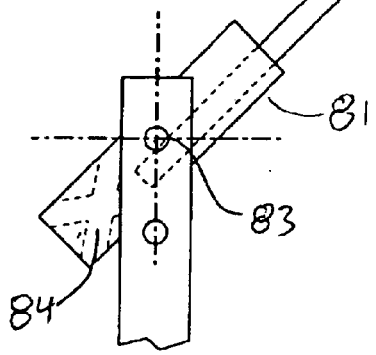
Figure 9C:
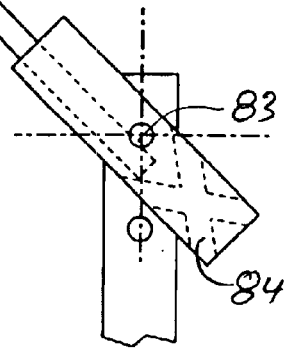
Figure 10:
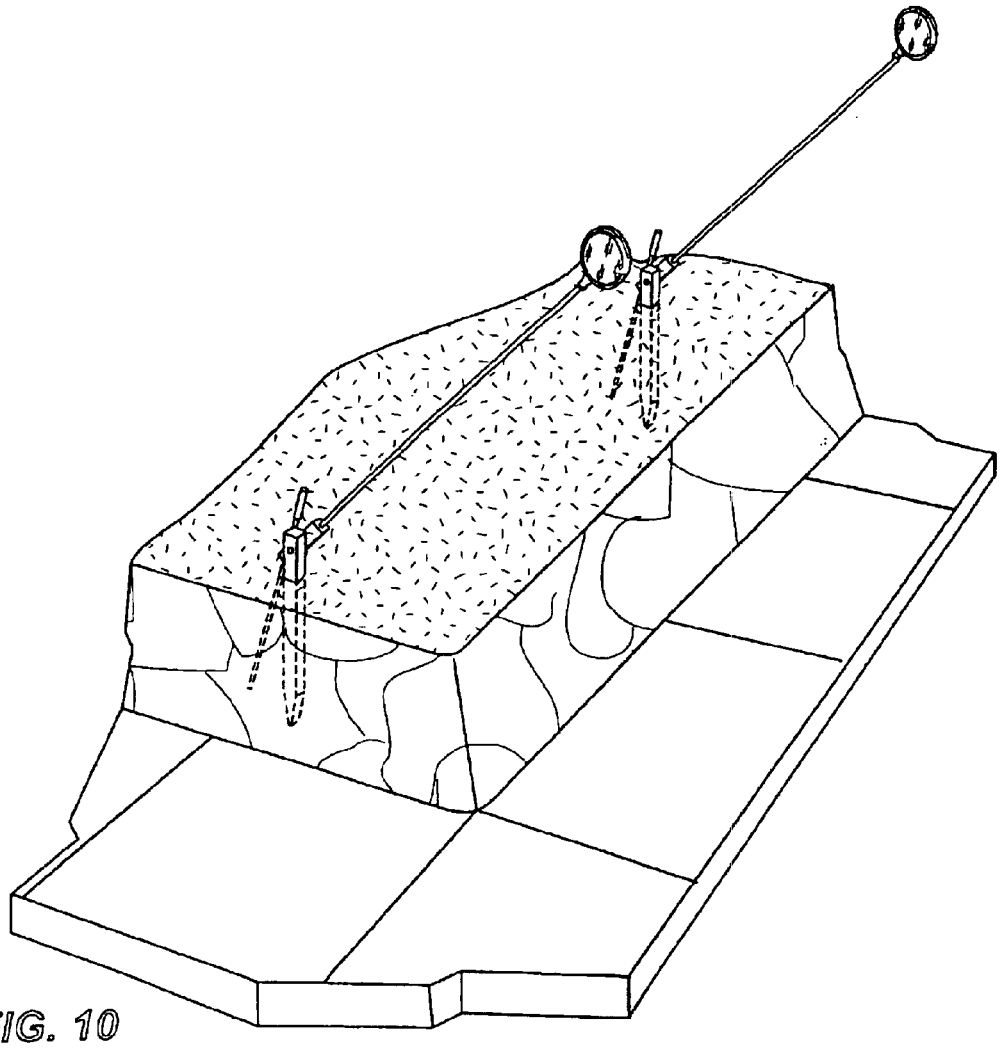
FIG. 10: Is a perspective view of the markers in position.

FIG. 6 shows a marker (10) with a different visual guiding section (12') and a different peg (28') and the said peg (28') is rotatably attached to a spacing rod holder (81). An angle holding rod (82) is planted in the ground after the peg (28') is planted and the marker (10) positioned at a given angle. In this manner, the angle of the marker (10) is maintained. As can be better appreciated in the three views of FIG. 9, a connector (83) rotatably engages the spacing rod holder (81) and said spacing rod holder (81) is further comprised of diagonal channels (84) generally but not necessarily crisscrossing in a pattern in the shape of an "X" and through any one of those channels (84) can pass the angle holding rod (82) in order to maximize the variety of planting angles available according to the nature of the terrain. For example, if the marker (10) needs to be set at an angle lower than the height of the peg (28') because the terrain is high in relation to a driveway then one channel (84) may be better suited than the other.

In the event that the terrain is very hard or that for one reason or another it is not possible to plant anything too deep, a block adapter (85) as in FIGS. 13, 11 and 12 can be used in combination with standard nails (86) that way the peg (28') is not used. The block adapter (85) is releasably attached to the peg (28') by way of tenons (87) engaging in suitably configured and sized holes (88) in the peg (28'). Planting both nails as per FIG. 11 ensures that the block adapter (85) and the peg (28') become securedly attached to one another for as long as the the marker (10) is needed.

What is claimed is:

1. An adjustable marker for delimiting boundaries, comprising:

an anchoring peg, an intermediate spacing rod section with a pair of pivotal connections; a first pivotal connection of said pair of pivotal connections pivotally engaging said anchoring peg to said intermediate spacing rod section, a visual guiding section; a second pivotal connection of said pair of pivotal connections pivotally engaging said visual guiding section to said intermediate spacing rod section;

said visual guiding section providing an easily visible visual sign, said intermediate spacing rod section positioning said visual guiding section relative to said anchoring peg, and said anchoring peg anchoring said marker to a ground surface, said anchoring peg having a generally pointed configuration defining a tip and a manipulating section located opposite said tip, said manipulating section including a tag spacing wall extending therefrom, said wall being further comprised of a connecting tongue at one end of said wall and configured and sized for receiving said first pivotal connection, and said first pivotal connection being fixedly attached to said intermediate spacing rod section.

2. The adjustable marker for delimiting boundaries as disclosed in claim 1, further comprising:

said first pivotal connection and said second pivotal connection each including a pair of cooperating pivotal discs having a matching internal configuration; a pivoting pin and a biasing component, said pivoting pin and biasing component pivotally connecting said pivotal discs; wherein said discs form a casing in which said pivoting pin and biasing component are mounted, so as to bias said pivotal discs to releasably lock each of said first pivotal connection and said second pivotal connection.

3. The adjustable marker for delimiting boundaries as disclosed in claim 1, further comprising:

said visual guiding section including a guiding strip typically painted, coated, or otherwise marked with visual enhancing means for enhancing visibility.

4. An adjustable marker for delimiting boundaries comprising:

a visual guiding section, a spacing rod holding the visual guiding section at a first end of said spacing rod, a spacing rod holder for holding said spacing rod at a second end of said spacing rod, an angle holding rod, said angle holding rod passing through said spacing rod holder, and said spacing rod holder being rotatably attached to a peg by way of a connector; a plurality of holes located in said peg; a block adapter usable in combination with a standard nail, said block adapter releasably attached to said peg by way of a plurality of suitably configured and sized tenons engaging said holes.

5. The adjustable marker for delimiting boundaries as disclosed in claim 4, further comprising:

diagonal channels within said spacing rod holder through which said angle holding rod passes.

* * * * *